US009869950B1

(12) United States Patent
Leemhuis

(10) Patent No.: US 9,869,950 B1
(45) Date of Patent: Jan. 16, 2018

(54) TONER AGITATOR ASSEMBLY

(71) Applicant: LEXMARK INTERNATIONAL, INC., Lexington, KY (US)

(72) Inventor: Michael Craig Leemhuis, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/433,001

(22) Filed: Feb. 15, 2017

(51) Int. Cl.
*G03G 15/08* (2006.01)

(52) U.S. Cl.
CPC ..... *G03G 15/0889* (2013.01); *G03G 15/0865* (2013.01)

(58) Field of Classification Search
CPC ..... G03G 15/0889; G03G 15/0865
USPC ..... 399/254, 256
See application file for complete search history.

(56) References Cited

U.S. PATENT DOCUMENTS 5,655,195 A 8/1997 Ichikawa et al.
6,418,290 B1 7/2002 Isomura et al.
6,459,876 B1 10/2002 Buchanan et al.
6,771,922 B2 8/2004 Blanck et al.
7,433,632 B2 10/2008 Askren et al.
7,532,843 B2 5/2009 Kern et al.
8,208,839 B2 * 6/2012 Mase ..... G03G 15/0872 399/256
8,660,469 B2 2/2014 Carter, II et al.
8,989,611 B2 3/2015 Leemhuis et al.
9,360,796 B2 6/2016 Leemhuis et al.
9,389,582 B2 7/2016 Carpenter et al.
2013/0223857 A1 * 8/2013 Tsuchiya ..... G03G 15/0858 399/27
2015/0261134 A1 * 9/2015 Kikuchi ..... G03G 15/0889 399/254

* cited by examiner

*Primary Examiner* — Sandra Brase
(74) *Attorney, Agent, or Firm* — Justin M. Tromp

(57) ABSTRACT

A toner container according to one example embodiment includes a housing having a reservoir for storing toner and a drive shaft positioned in the reservoir. The drive shaft is rotatable about a rotational axis in an operative rotational direction. A toner agitator extends from the drive shaft in the reservoir. The toner agitator is rotatable around the rotational axis of the drive shaft as the drive shaft rotates. The toner agitator folds relative to the drive shaft counter to the operative rotational direction if resistance to rotation of the toner agitator provided by toner in the reservoir exceeds a threshold amount. The toner agitator is biased relative to the drive shaft in the operative rotational direction. A radial length of the toner agitator decreases when the toner agitator folds relative to the drive shaft counter to the operative rotational direction.

20 Claims, 11 Drawing Sheets

TONER AGITATOR ASSEMBLY

CROSS REFERENCES TO RELATED APPLICATIONS

None.

BACKGROUND

1. Field of the Disclosure

The present disclosure relates generally to image forming devices and more particularly to a toner agitator assembly for an electrophotographic image forming device.

2. Description of the Related Art

In electrophotographic image forming devices, one or more replaceable units may be used to supply toner for printing onto sheets of media. For example, a toner cartridge may supply toner stored in a reservoir within the toner cartridge through an outlet port on the toner cartridge to a corresponding inlet port in the image forming device. Toner cartridges often include a toner agitator assembly within the toner reservoir that agitates and mixes the toner to prevent the toner from clumping and that moves the toner to the outlet port. Current industry trends favor larger toner cartridges having a greater toner capacity in order to reduce the frequency of toner cartridge replacement required by the user and to reduce the cost of toner per page to the user. However, the torque required to rotate a toner agitator assembly within the toner reservoir generally increases as the amount of toner increases. It has been observed that vibrating a toner cartridge (such as may occur during shipment of the toner cartridge) tends to pack the toner stored in the reservoir, which further increases the torque required to rotate the toner agitator assembly within the toner reservoir. Long periods of inactivity (such as during storage of the toner cartridge prior to shipment or first use of the toner cartridge) may also tend to pack the toner stored in the reservoir.

An electric motor in the image forming device typically provides rotational force to the toner agitator assembly via a gear train or other drive transmission. If the motor is unable to provide the torque necessary to rotate the toner agitator assembly, the motor may stall or damage to the toner agitator assembly may occur. One solution to ensure that sufficient torque is provided to the toner agitator assembly is to increase the size of the motor that drives the toner agitator assembly. However, this typically increases the cost of the motor and requires more space within the image forming device, which is contrary to consumer preferences for smaller image forming devices. Another solution is for the image forming device to alert the user to remove the toner cartridge from the image forming device and shake the toner cartridge to loosen packed toner if the motor is unable to provide the torque necessary to rotate the toner agitator assembly. However, it is generally undesirable to require user intervention as it may decrease user satisfaction with the image forming device.

Accordingly, a solution to decrease the torque required to rotate a toner agitator assembly within a toner reservoir containing packed toner is desired.

SUMMARY

A toner container for use in an electrophotographic image forming device according to one example embodiment includes a housing having a reservoir for storing toner. A drive shaft is positioned in the reservoir. The drive shaft is rotatable about a rotational axis in an operative rotational direction. A rigid toner agitator extends in a cantilevered manner from the drive shaft in the reservoir. The toner agitator is rotatable around the rotational axis of the drive shaft as the drive shaft rotates in the operative rotational direction. The toner agitator folds relative to the drive shaft counter to the operative rotational direction if resistance to rotation of the toner agitator provided by toner in the reservoir exceeds a threshold amount. The toner agitator is biased relative to the drive shaft in the operative rotational direction. A radial length of the toner agitator from the rotational axis of the drive shaft to a free end of the toner agitator relative to the drive shaft decreases when the toner agitator folds relative to the drive shaft counter to the operative rotational direction. In some embodiments, the toner agitator is pivotable relative to the drive shaft about a pivot axis that is offset from the rotational axis of the drive shaft and fixed relative to the rotational axis of the drive shaft.

A toner container for use in an electrophotographic image forming device according to another example embodiment includes a housing having a reservoir for storing toner. A drive shaft is positioned in the reservoir. The drive shaft is rotatable about a rotational axis in an operative rotational direction. A toner agitator extends outward from the drive shaft in the reservoir. The toner agitator is rotatable around the rotational axis of the drive shaft as the drive shaft rotates in the operative rotational direction. The toner agitator is pivotable relative to the drive shaft about a pivot axis that is offset from the rotational axis of the drive shaft. The pivot axis of the toner agitator is fixed relative to the rotational axis of the drive shaft. The toner agitator is biased relative to the drive shaft in the operative rotational direction toward an extended position of the toner agitator. The toner agitator moves from the extended position to a retracted position of the toner agitator when the toner agitator pivots about the pivot axis from the extended position counter to the operative rotational direction. A distal end of the toner agitator is positioned farthest from the rotational axis of the drive shaft when the toner agitator is in the extended position. A radial length of the toner agitator from the rotational axis of the drive shaft to the distal end of the toner agitator is greater when the toner agitator is in the extended position than when the toner agitator is in the retracted position.

In some embodiments, the pivot axis of the toner agitator is parallel to the rotational axis of the drive shaft.

Embodiments include those wherein an exposed face of the toner agitator in the operative rotational direction decreases when the toner agitator moves from the extended position to the retracted position.

In some embodiments, the toner agitator extends in a radial orientation relative to the drive shaft when the toner agitator is in the extended position. In one example embodiment, the pivot axis of the toner agitator is positioned at ⅓ the radial length of the toner agitator when the toner agitator is in the extended position.

In some embodiments, the toner agitator is pivotally mounted about the pivot axis to a drive arm that extends radially from the drive shaft and that is fixed to rotate with the drive shaft. In one example embodiment, the drive arm includes a first drive arm and a second drive arm that are axially spaced from each other relative to the rotational axis of the drive shaft. Each of the first drive arm and the second drive arm extends radially from the drive shaft and is fixed to rotate with the drive shaft. The toner agitator is pivotally mounted about the pivot axis to the first and the second drive arms. In one example embodiment, the toner agitator includes an arm that is pivotally mounted to the drive arm at the pivot axis of the toner agitator. A proximal end of the arm is positioned proximate to the drive shaft when the toner agitator is in the extended position and the proximal end of the arm projects forward in the operative rotational direction ahead of the drive arm when the toner agitator is in the retracted position.

Embodiments include those wherein a proximal end of the toner agitator opposite the distal end of the toner agitator relative to the pivot axis of the toner agitator projects forward in the operative rotational direction when the toner agitator is in the retracted position.

In one example embodiment, the toner agitator is biased toward the extended position of the toner agitator by a double torsion spring. The double torsion spring includes a pair of spring coils and a connecting arm that connects the pair of spring coils to each other and that contacts a trailing portion of the toner agitator relative to the operative rotational direction biasing the toner agitator relative to the drive shaft in the operative rotational direction.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
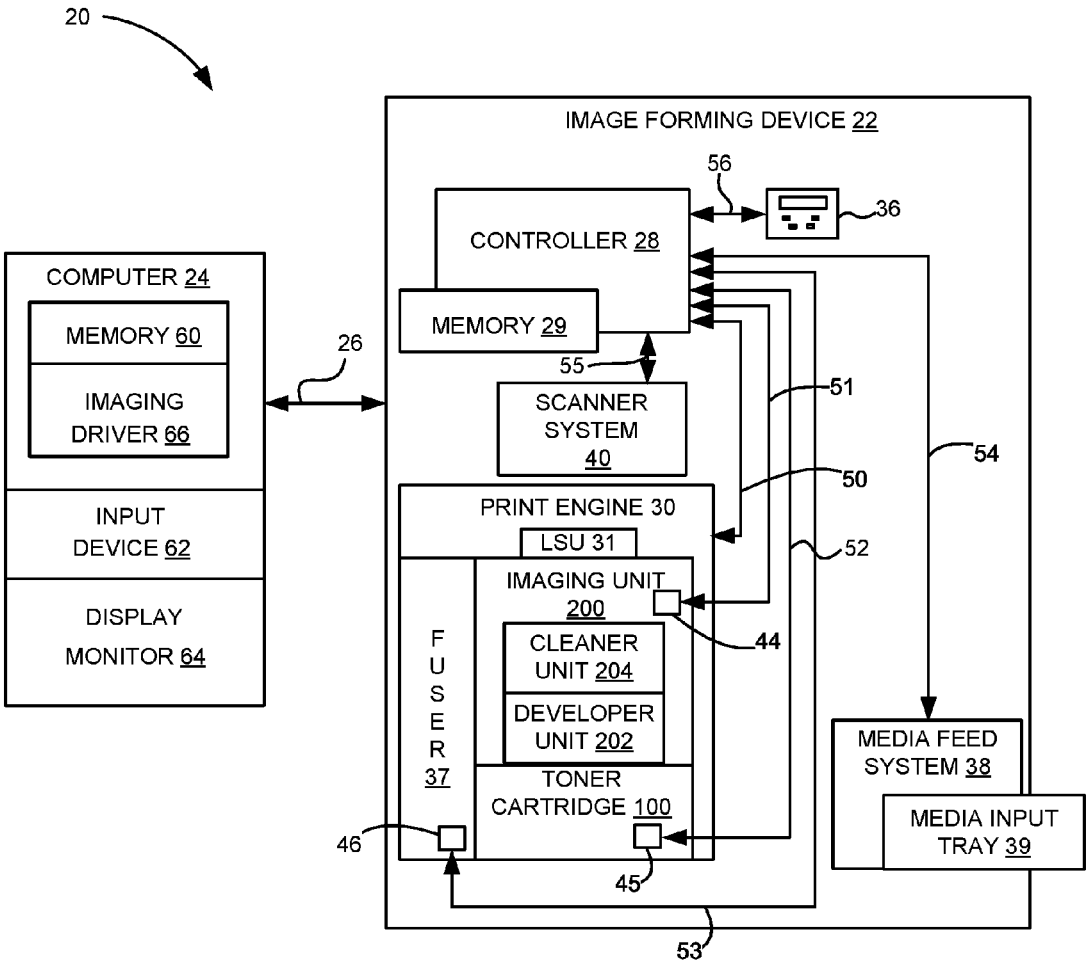
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
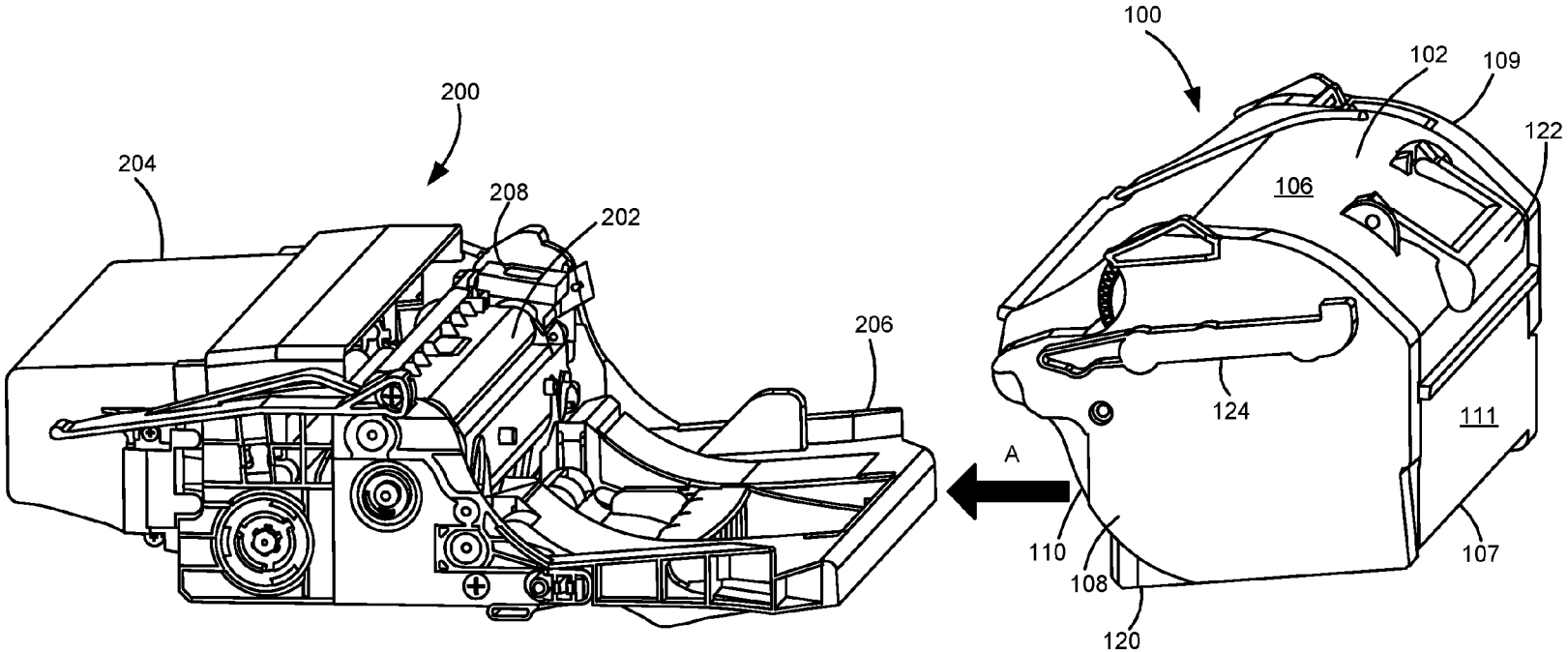
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. An outlet port 118 in fluid communication with reservoir 104 is positioned on front 110 of housing 102 near side 109 for exiting toner from toner cartridge 100. Housing 102 may include legs 120 on bottom 107 to assist with the insertion of toner cartridge 100 into image forming device 22 and to support housing 102 when toner cartridge 100 is set on a flat surface. A handle 122 may be provided on top 106 or rear 111 of housing 102 to assist with insertion and removal of toner cartridge 100 into and out of image forming device 22.

Figure 3:
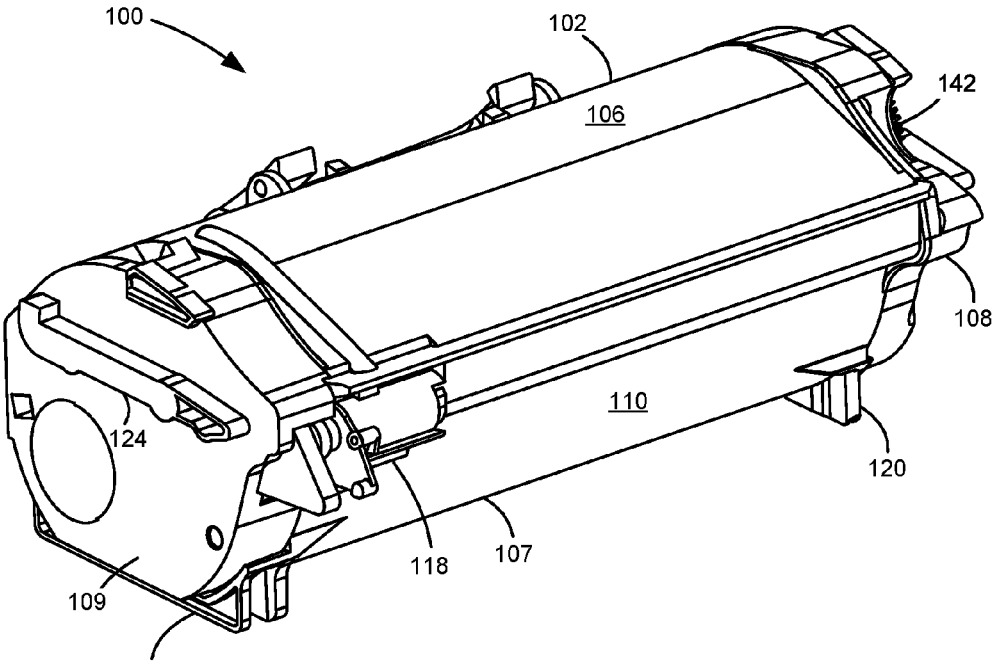
FIG. 3 is a front perspective view of the toner cartridge shown in FIG. 2.
Figure 4:
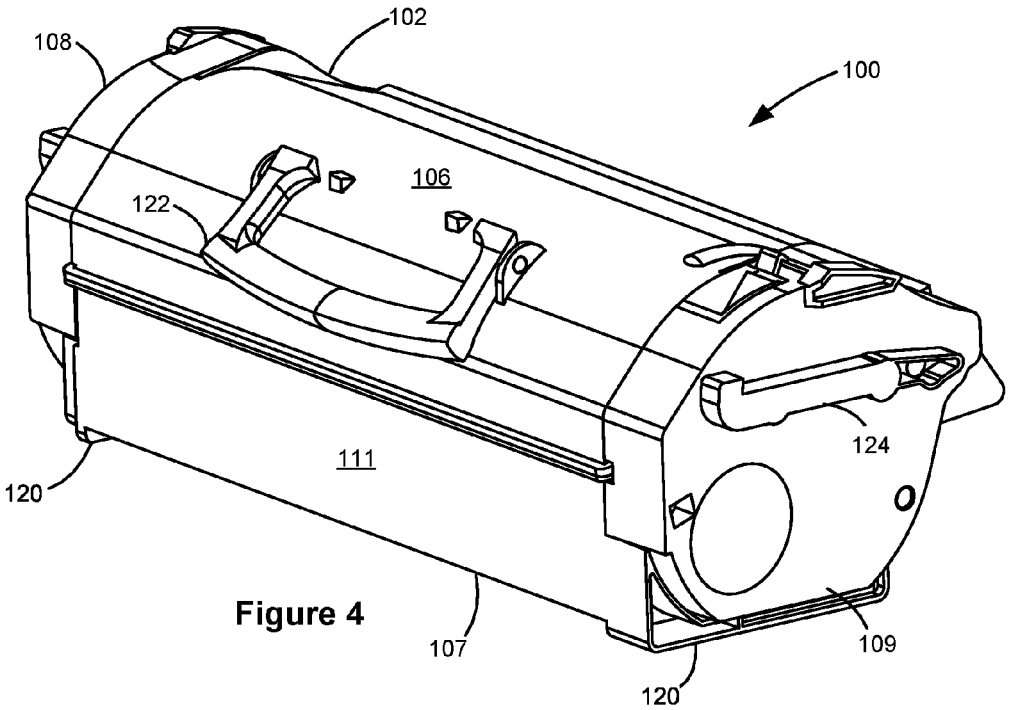
FIG. 4 is a rear perspective view of the toner cartridge shown in FIGS. 2 and 3.

Sides 108, 109 may each include an alignment guide 124 that extends outward from the respective side 108, 109 to assist the insertion of toner cartridge 100 into image forming device 22. Alignment guides 124 travel in corresponding guide slots in image forming device 22 that guide the insertion of toner cartridge 100 into image forming device 22. In the example embodiment illustrated, an alignment guide 124 is positioned on the outer side of each end cap 112, 113. Alignment guides 124 may run along a front-to-rear dimension of housing 102 as shown in FIGS. 2-4.

Figure 5:
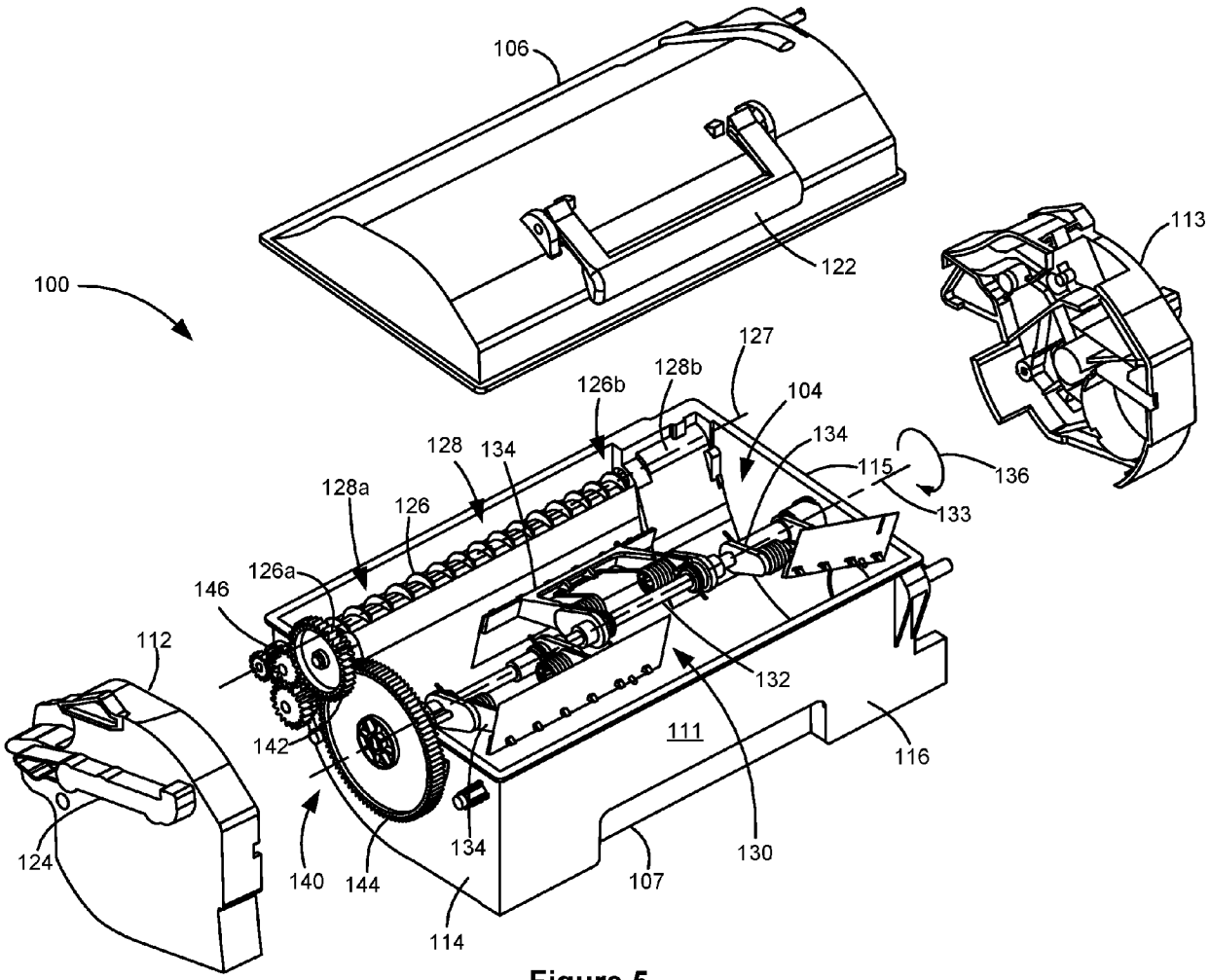
FIG. 5 is an exploded view of the toner cartridge shown in FIGS. 2-4 showing a reservoir for holding toner therein.

With reference to FIG. 5, in the example embodiment illustrated, an auger 126 having first and second ends 126*a*, 126*b* and a spiral screw flight is positioned in a channel 128 that runs along the front 110 of housing 102 from side 108 to side 109. Channel 128 may be integrally molded as part of the front 110 of main body 116 or formed as a separate component that is attached to the front 110 of main body 116. Channel 128 is oriented generally horizontal when toner cartridge 100 is installed in image forming device 22. Auger 126 includes a rotational axis 127. Rotation of auger 126 delivers toner in channel 128 to outlet port 118, which is positioned at the bottom of channel 128 so that gravity assists in exiting toner through outlet port 118. Channel 128 includes an open portion 128*a* and may include an enclosed portion 128*b*. Open portion 128*a* is open to toner reservoir 104 and extends from side 108 toward second end 126*b* of auger 126. Enclosed portion 128*b* of channel 128 extends from side 109 and encloses second end 126*b* of auger 126. In this embodiment, outlet port 118 is positioned at the bottom of enclosed portion 128*b* of channel 128.

A toner agitator assembly 130 is rotatably positioned within toner reservoir 104. Toner agitator assembly 130 includes a rotatable drive shaft 132 and one or more toner agitators 134 that extend outward in a cantilevered manner from drive shaft 132 as discussed in greater detail below. Drive shaft 132 includes a rotational axis 133. In the example embodiment illustrated, rotational axis 133 of drive shaft 132 is parallel to rotational axis 127 of auger 126. In one embodiment, drive shaft 132 is composed of metal, such as steel, to handle the torque loads that result from resistance to the rotation of toner agitators 134 provided by toner in reservoir 104. In other embodiments, drive shaft 132 is composed of a rigid plastic material. In operation, drive shaft 132 rotates in an operative rotational direction 136. Toner agitators 134 rotate with drive shaft 132 around rotational axis 133 when drive shaft 132 rotates in operative rotational direction 136. As drive shaft 132 rotates, toner agitators 134 agitate and mix the toner stored in toner reservoir 104 and, in the embodiment illustrated, move toner toward channel 128 where auger 126 moves the toner to outlet port 118. In the example embodiment illustrated, first and second ends of drive shaft 132 extend through aligned openings in side walls 114, 115, respectively. However, drive shaft 132 may take other positions and orientations as desired. Bushings may be provided on an inner side of each side wall 114, 115 where drive shaft 132 passes through side walls 114, 115.

A drive train 140 is operatively connected to drive shaft 132 and may be positioned within a space formed between end cap 112 and side wall 114. Drive train 140 includes a main input gear 142 that engages with a drive transmission in image forming device 22 that provides rotational motion from an electric motor in image forming device 22 to main input gear 142. As shown in FIG. 3, in one embodiment, a front portion of main input gear 142 is exposed at the front 110 of housing 102 near the top 106 of housing 102 where main input gear 142 engages the drive transmission in image forming device 22. With reference back to FIG. 5, in the embodiment illustrated, drive train 140 also includes a drive gear 144 on one end of drive shaft 132 that is connected to main input gear 142 either directly or via one or more intermediate gears to rotate drive shaft 132. In the embodiment illustrated, drive train 140 also includes a drive gear 146 on first end 126*a* of auger 126 that is connected to main input gear 142 either directly or via one or more intermediate gears to rotate auger 126.

Figure 6:
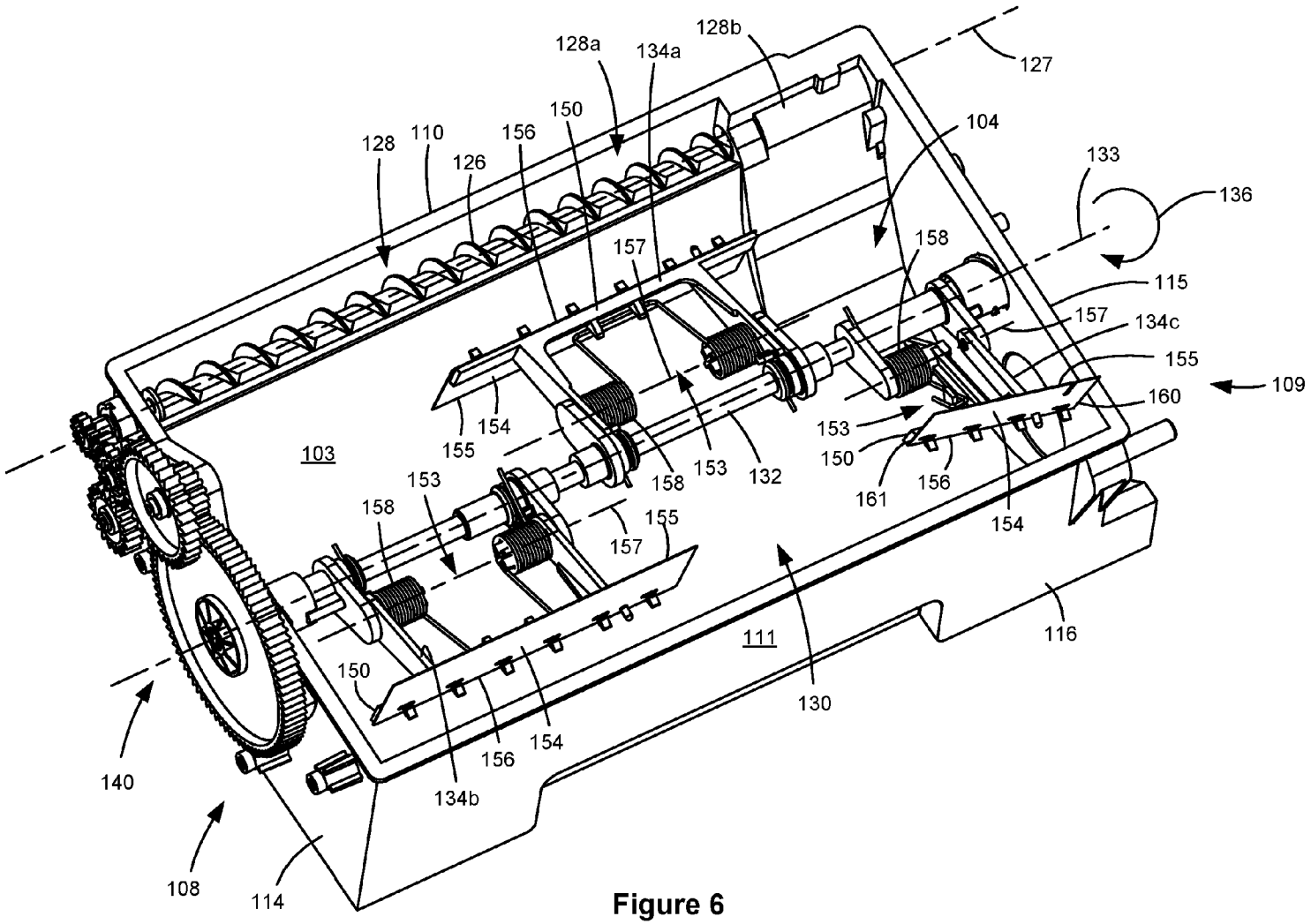
FIG. 6 is a perspective view of the reservoir of the toner cartridge showing toner agitators in extended positions according to one example embodiment.

FIG. 6 shows toner agitator assembly 130 in greater detail according to one example embodiment. In the example embodiment illustrated, toner agitator assembly 130 includes three toner agitators labeled 134*a*, 134*b*, 134*c*. However, more or fewer than three toner agitators 134 may be used as desired depending on, for example, the size of toner reservoir 104. In the example embodiment illustrated, adjacent toner agitators 134 alternate radially by 180 degrees along the length of drive shaft 132. This arrangement of toner agitators 134 keeps the torque on drive shaft 132 more uniform in comparison with toner agitators 134 all extending in the same radial direction. However, toner agitators 134 may alternate radially relative to each other by any suitable amount and in any suitable arrangement as desired. In the example embodiment illustrated, each toner agitator 134 includes a paddle 150 that is spaced from drive shaft 132. In the embodiment illustrated, each paddle 150 includes a substantially planar member. Paddles 150 may be composed of, for example, a rigid plastic material. For example, paddles 150 may be composed of acrylonitrile butadiene styrene (ABS), e.g., POLYLAC® ABS PA-757 available from Chi Mei Corporation, Tainan City, Taiwan. Each paddle 150 includes a free or distal end 151 and a proximal end 152 relative to drive shaft 132 (FIGS. 8-11). Proximal end 152 is positioned closer to drive shaft 132 along a radial dimension of drive shaft 132 than distal end 151 is. In the embodiment illustrated, a gap 153 is formed between each paddle 150 and drive shaft 132 to allow toner in reservoir 104 to freely move near a central core of reservoir 104 along the length of drive shaft 132. A wiper 154 is mounted on each paddle 150 and extends in a cantilevered manner away from distal end 151 of paddle 150 toward an interior surface 103 of housing 102 forming reservoir 104. Wipers 154 are formed from a flexible material such as a polyethylene terephthalate (PET) material, e.g., MYLAR® available from DuPont Teijin Films, Chester, Va., USA. Each wiper 154 includes a distal end 155 and a proximal end 156 relative to drive shaft 132. Distal end 155 is positioned farthest from paddle 150, nearest to the interior surface 103 of housing 102 and proximal end 156 is positioned on paddle 150. In one embodiment, wipers 154 form an interference fit with the interior surfaces 103 of top 106, bottom 107, front 110 and rear 111 in order to wipe toner from the interior surfaces 103 as drive shaft 132 rotates.

Each toner agitator 134 is configured to fold, bend or otherwise retract counter to operative rotational direction 136 if the resistance to the rotation of toner agitator 134 provided by toner in reservoir 104 exceeds a threshold amount. In the embodiment illustrated, each toner agitator 134 is individually foldable counter to operative rotational direction 136, independent of the other toner agitators 134. In other embodiments, two or more of toner agitators 134 may fold together counter to operative rotational direction 136. In some embodiments, each toner agitator 134 pivots counter to operative rotational direction 136 about a respective pivot axis 157 that is offset from rotational axis 133 of drive shaft 132. In the example embodiment illustrated, each pivot axis 157 is fixed relative to rotational axis 133 of drive shaft 132. In the example embodiment illustrated, each pivot axis 157 is parallel to rotational axis of drive shaft 132; however, pivot axes 157 may instead be angled relative to rotational axis 133 of drive shaft 132. When a toner agitator 134 folds counter to operative rotational direction 136, a radial length of toner agitator 134 decreases, thereby decreasing the torque required to rotate the toner agitator 134. For example, a radial distance from drive shaft 132 to a distal end of the toner agitator 134 decreases when the toner agitator 134 folds counter to operative rotational direction 136. In the embodiment illustrated, the radial distance from drive shaft 132 to paddle 150 and wiper 154 decreases when toner agitator 134 folds counter to operative rotational direction 136. When a toner agitator 134 folds counter to operative rotational direction 136, the exposed face of toner agitator 134 (in this case, the exposed face of paddle 150 and wiper 154) in the operative rotational direction 136 also decreases, also decreasing the torque required to rotate the toner agitator 134. FIG. 6 shows toner agitators 134 in extended positions whereas FIG. 7 shows toner agitators 134 in retracted positions upon folding counter to operative rotational direction 136.

Figure 7:
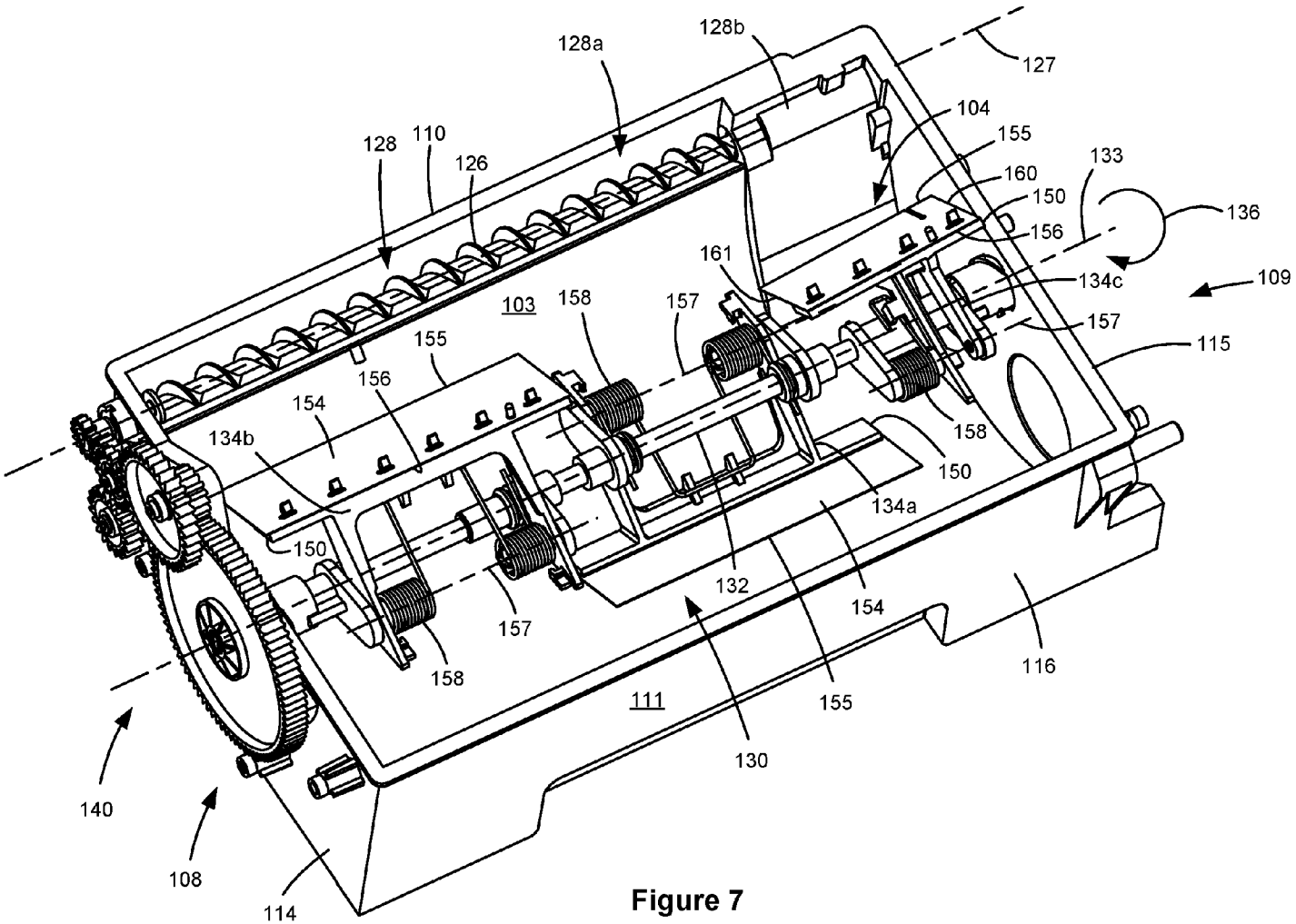
FIG. 7 is a perspective view of the reservoir of the toner cartridge showing toner agitators in retracted positions according to one example embodiment.

With continued reference to FIGS. 6 and 7, each toner agitator 134 is biased forward, in the operative rotational direction 136 by a biasing member 158 toward an extended position of the toner agitator 134 (shown in FIG. 6). In the example embodiment illustrated, each toner agitator 134 extends in a substantially radial orientation relative to drive shaft 132 when the toner agitator 134 is in its extended position. In the example embodiment illustrated, biasing members 158 include torsion springs; however, any suitable biasing member 158 may be used, such as one or more compression springs, extension springs, leaf springs, or other forms of resilient members. In the example embodiment illustrated, biasing members 158 are sized such that toner agitators 134 remain in their extended positions during normal operation. In this manner, the extended positions of toner agitators 134 serve as the normal operating positions of toner agitators 134. In this configuration, each toner agitator 134 only folds counter to operative rotational direction 136 when the torque required to rotate the toner agitator 134 exceeds a threshold amount (for example, torque exceeding approximately 1-2 lb-in per toner agitator 134) that typically indicates that toner agitator 134 has encountered packed toner in reservoir 104. In this manner, the amount of torque required to rotate toner agitator 134 is decreased in comparison with a toner agitator having a fixed radial length when high resistance from packed toner in reservoir 104 is encountered in order to prevent damage to toner agitator assembly 130 and to avoid stalling the electric motor in image forming device 22 that drives toner agitator assembly 130. This reduction in torque occurs automatically upon toner agitator 134 encountering packed toner and folding counter to operative rotational direction 136 without requiring user intervention and is generally more cost effective than overcoming high torque loads by increasing the size of the electric motor that drives toner agitator assembly 130.

In the embodiment illustrated, each toner agitator 134 folds counter to operative rotational direction 136 to a degree proportional to the resistance provided by the packed toner. That is, greater resistance by packed toner in reservoir 104 causes toner agitator 134 to fold further counter to operative rotational direction 136 than if packed toner in reservoir 104 provides less resistance. As discussed in greater detail below, a rearward stop sets a limit on how far toner agitator 134 can fold counter to operative rotational direction 136 when toner agitator 134 encounters high resistance from packed toner. The spring rate of biasing member 158 is chosen such that toner agitator 134 is able to reach the rearward stop before the torque required to drive toner agitator 134 reaches an amount that would stall the electric motor in image forming device 22 that drives toner agitator assembly 130. After encountering packed toner, toner agitator 134 gradually returns to its extended position as drive shaft 132 rotates and the packed toner is broken up by the rotation of toner agitator assembly 130. Once the packed toner in reservoir 104 is broken up, toner agitators 134 are free to operate in their extended, normal operating positions. As the toner level in reservoir 104 decreases, a gradually increasing air gap forms at the top of reservoir 104 above the toner in reservoir 104. As a result, if packed toner is present in reservoir 104 when reservoir 104 is not full of toner, toner agitators 134 tend to fold counter to operative rotational direction 136 upon contacting the compacted toner and then return to their extended positions upon reaching the air gap at the top of reservoir 104. Toner agitators 134 continue to alternate between their extended positions and retracted positions in this manner, with the extent of retraction gradually decreasing as the packed toner is broken up, as drive shaft 132 rotates until toner agitators 134 are free to operate in their extended positions.

In the example embodiment illustrated, toner agitators 134*a*, 134*b* are aligned in the axial dimension of drive shaft 132 with open portion 128*a* of channel 128 and toner agitator 134*c* is aligned in the axial dimension of drive shaft 132 with closed portion 128*b* of channel 128. In the example embodiment illustrated, toner agitators 134*a*, 134*b* are structurally identical to each other but are rotated 180 degrees from each other. However, in this embodiment, toner agitator 134*c* differs from toner agitators 134*a*, 134*b* in that, in at least the extended position of toner agitator 134*c*, paddle 150 and wiper 154 of toner agitator 134*c* are angled relative to drive shaft 132. Specifically, an outer axial end 160 of paddle 150 of toner agitator 134*c* is positioned ahead of an inner axial end 161 of paddle 150 of toner agitator 134*c* in the operative rotational direction 136. In contrast, paddles 150 of toner agitators 134*a*, 134*b* extend substantially parallel to drive shaft 132. The angling of paddle 150 and wiper 154 of toner agitator 134*c* causes toner agitator 134*c* to move toner axially inward, away from side 109 and toward open portion 128*a* of channel 128 as distal end 155 of wiper 154 of toner agitator 134*c* passes closed portion 128*b* of channel 128 when toner agitator 134*c* is in the extended position. In the extended positions of toner agitators 134*a*, 134*b*, wipers 154 of toner agitators 134*a*, 134*b* flip toner into open portion 128*a* of channel 128 as distal ends 155 of wipers 154 pass open portion 128*a* of channel 128 along the interior surface 103 of front 110 of housing 102. In the example embodiment illustrated, in the extended positions of toner agitators 134*a*, 134*b*, 134*c*, distal ends 151 of paddles 150 and distal ends 155 of wipers 154 of toner agitators 134*a*, 134*b*, 134*c* are each positioned at a uniform radial distance from drive shaft 132 and are each angled rearward such that proximal ends 152, 156 of paddle 150 and wiper 154 of toner agitators 134*a*, 134*b*, 134*c* are positioned ahead of distal ends 151, 155 in operative rotational direction 136 in order to further encourage wipers 154 to flip toner toward front 110 as distal ends 155 of wipers 154 of toner agitators 134*a*, 134*b*, 134*c* pass channel 128.

Figure 8:
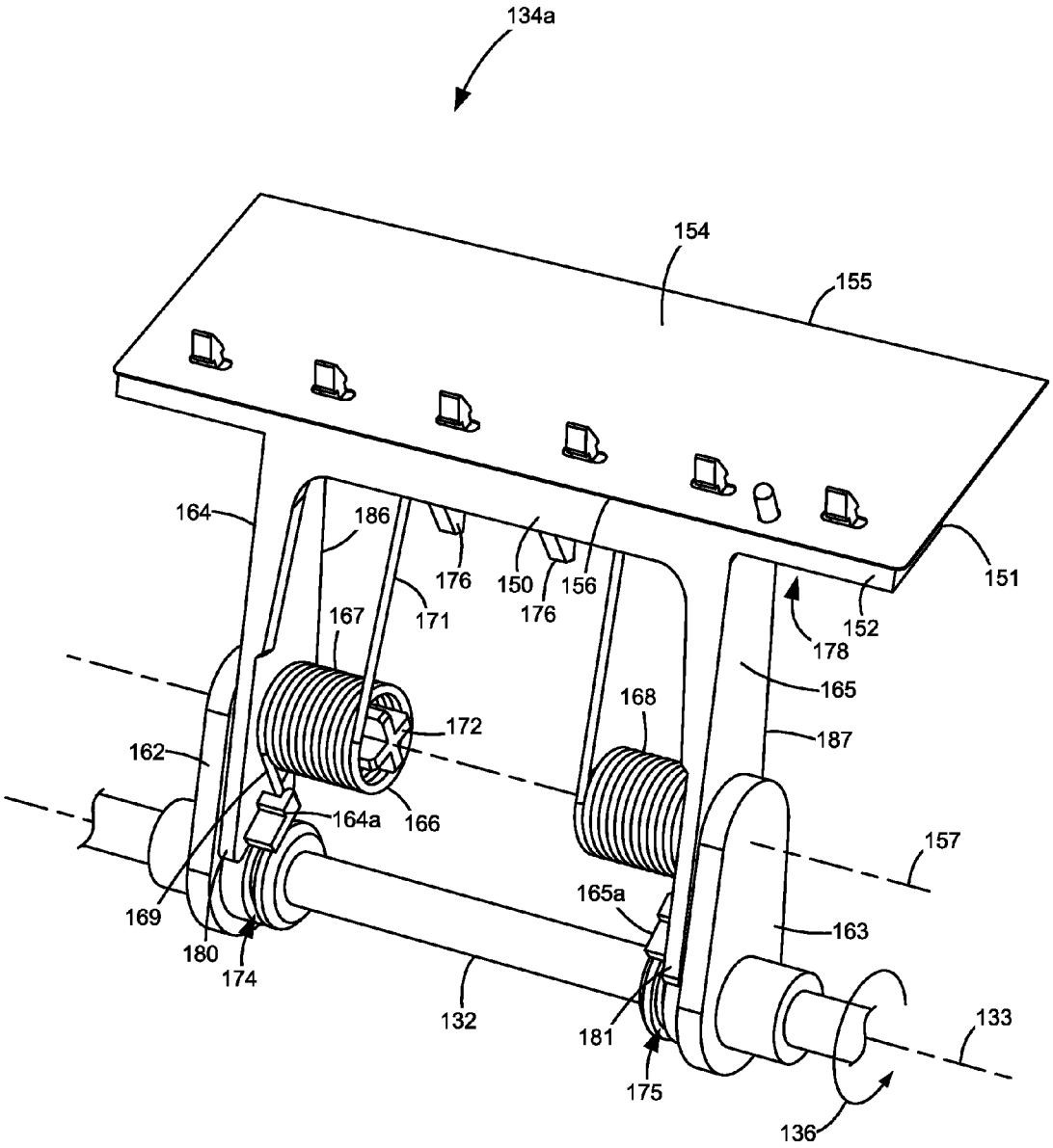
FIG. 8 is a perspective view of a first toner agitator in an extended position according to one example embodiment.
Figure 9:
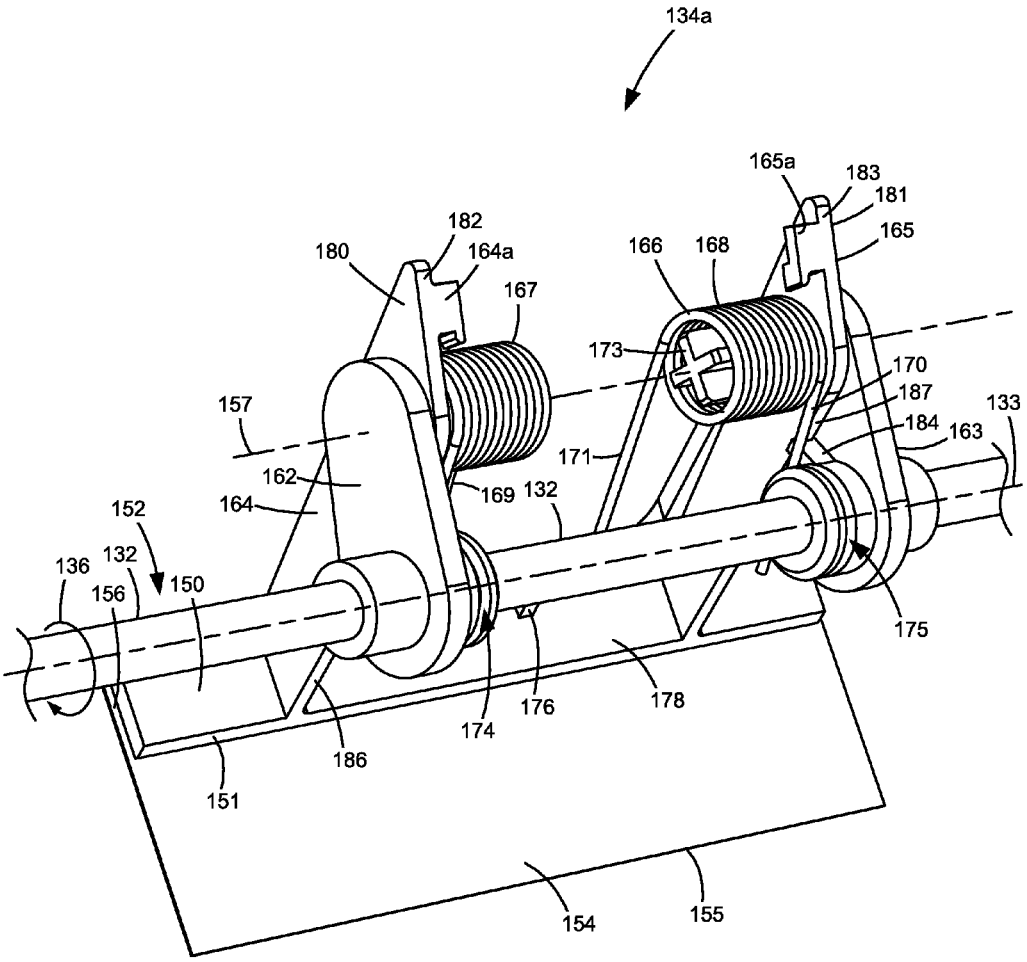
FIG. 9 is a perspective view of the first toner agitator in a retracted position according to one example embodiment.

FIGS. 8 and 9 show toner agitator 134*a* in greater detail according to one example embodiment. FIG. 8 shows toner agitator 134*a* in its extended position and FIG. 9 shows toner agitator 134*a* in its fully retracted position. As mentioned above, toner agitator 134*b* may be structurally identical to toner agitator 134*a*. Toner agitator 134*a* includes a pair of drive arms 162, 163 that are fixed to drive shaft 132 and axially spaced from each other relative to rotational axis 133 of drive shaft 132. Drive arms 162, 163 extend radially from drive shaft 132 and are fixed to rotate with drive shaft 132. Drive arms 162, 163 may be formed integrally with drive shaft 132 or attached thereto. In one embodiment, drive arms 162, 163 are composed of a rigid plastic material over-molded onto drive shaft 132. For example, drive arms 162, 163 may be composed of polycarbonate, e.g., VYTEEN® PC GF20BK available from The Lavergne Group, Anjou, Quebec, Canada. In the example embodiment illustrated, paddle 150 and wiper 154 of toner agitator 134*a* are pivotally mounted to drive arms 162, 163 about pivot axis 157. Specifically, arms 164, 165, which are axially spaced from each other relative to rotational axis 133 of drive shaft 132, extend from paddle 150 of toner agitator 134*a* and are each pivotally mounted on a respective drive arm 162, 163. For example, in one embodiment, each arm 164, 165 includes a mounting hole that receives a corresponding post on a respective drive arm 162, 163 at pivot axis 157. The posts of drive arms 162, 163 are free to rotate within the mounting holes of arms 164, 165 permitting arms 164, 165, paddle 150 and wiper 154 to pivot about pivot axis 157. Of course, this configuration may be reversed such that each drive arm 162, 163 includes a mounting hole that receives a corresponding post on a respective arm 164, 165 at pivot axis 157. Arms 164, 164 may be formed integrally with paddle 150 or attached thereto and composed of, for example, a rigid plastic material such as ABS discussed above.

In the example embodiment illustrated, biasing member 158 includes a double torsion spring 166 having a pair of spring coils 167, 168. Spring coils 167, 168 each have a respective free arm 169, 170. A connecting arm 171 connects spring coils 167, 168 to each other. Each spring coil 167, 168 is wrapped around a corresponding spring post 172, 173 that extends axially inward from a respective arm 164, 165. Spring posts 172, 173 position and align spring coils 167, 168 with each other. In the example embodiment illustrated, free arms 169, 170 are each positioned in a corresponding spring groove 174, 175 that encircles drive shaft 132 at the base of a respective drive arm 162, 163. Spring grooves 174, 175 position free arms 169, 170 and aid in preventing free arms 169, 170 from dislocating during operation. The engagement between spring grooves 174, 175 and free arms 169, 170 also aids in preventing arms 164, 165 from separating from drive arms 162, 163 during operation. Connecting arm 171 extends from spring coils 167, 168 toward paddle 150 and is positioned against one or more ribs 176 on a trailing face 178 of paddle 150 (i.e., a face of paddle 150 that trails as toner agitator 134*a* rotates in operative rotational direction 136). Free arms 169, 170 and connecting arm 171 are substantially centered axially on paddle 150 such that double torsion spring 166 provides substantially uniform force on paddle 150 along the axial dimension of drive shaft 132 in order to prevent paddle 150 from twisting as a result of the bias applied to paddle 150 by double torsion spring 166. While the example embodiment illustrated includes a double torsion spring 166, as discussed above, any suitable biasing member 158 may be used as desired. For example, biasing member 158 may instead include a pair of torsion springs or a single torsion spring among other options.

In one embodiment, arms 164, 165 can be separated from drive arms 162, 163 by removing each free arm 169, 170 of double torsion spring 166 from its corresponding spring groove 174, 175 and manually squeezing arms 164, 165 toward each other until the posts of drive arms 162, 163 exit the mounting holes of arms 164, 165. This configuration permits relatively simple assembly and disassembly of paddle 150 of toner agitator 134*a* onto or off of drive arms 162, 163 and drive shaft 132. In the example embodiment illustrated, each arm 164, 165 includes a spring catch 164*a*, 165*a* that retains a respective free arm 169, 170 of double torsion spring 166 when paddle 150 is separated from drive arms 162, 163 and drive shaft 132 so that double torsion spring 166 does not separate from paddle 150. Spring catches 164*a*, 165*a* may also be used to pre-load double torsion spring 166 in order simplify the assembly of paddle 150 onto drive arms 162, 163 and drive shaft 132. Spring catches 164*a*, 165*a* do not affect the operation of toner agitator 134*a* after paddle 150 is assembled onto drive arms 162, 163 and drive shaft 132.

Each arm 164, 165 of toner agitator 134*a* includes a proximal portion 180, 181 that is positioned proximate to drive shaft 132 when toner agitator 134*a* is in its extended position. Proximal portions 180, 181 of arms 164, 165 each include a forward rotational stop 182, 183 that limits the pivoting motion of toner agitator 134*a* about pivot axis 157 relative to drive arms 162, 163 and drive shaft 132 in the direction of bias on toner agitator 134*a* (i.e., in the operative rotational direction 136). In this manner, forward rotational stops 182, 183 define the extended position of toner agitator 134*a*. In the example embodiment illustrated, in the extended position of toner agitator 134*a*, forward rotational stops 182, 183 contact a portion of the base of a respective drive arm 162, 163. In the example embodiment illustrated, arms 164, 165 extend in a substantially radial orientation relative to drive shaft 132 when toner agitator 134*a* is in its extended position.

In the example embodiment illustrated, each drive arm 162, 163 includes a rearward rotational stop 184 formed thereon. Rearward rotational stops 184 limit how far toner agitator 134*a* is able to fold counter to operative rotational direction 136. In the embodiment illustrated, as toner agitator 134*a* folds counter to operative rotational direction 136, a trailing side 186, 187 of each arm 164, 165 (i.e., a side of each arm 164, 165 that trails as toner agitator 134*a* rotates in operative rotational direction 136) contacts a corresponding rearward rotational stop 184 when toner agitator 134*a* reaches the fully retracted position shown in FIG. 9.

In the example embodiment illustrated, when toner agitator 134*a* is in a partially or fully retracted position, proximal portions 180, 181 of arms 164, 165 project radially outward from pivot axis 157 ahead of paddle 150 and wiper 154 of toner agitator 134*a* in the operative rotational direction 136. The projection of proximal portions 180, 181 of arms 164, 165 aids in cutting through and breaking up packed toner as toner agitator 134*a* rotates until toner agitator 134*a* returns to its extended position as a result of the bias applied by bias member 158.

Figure 10:
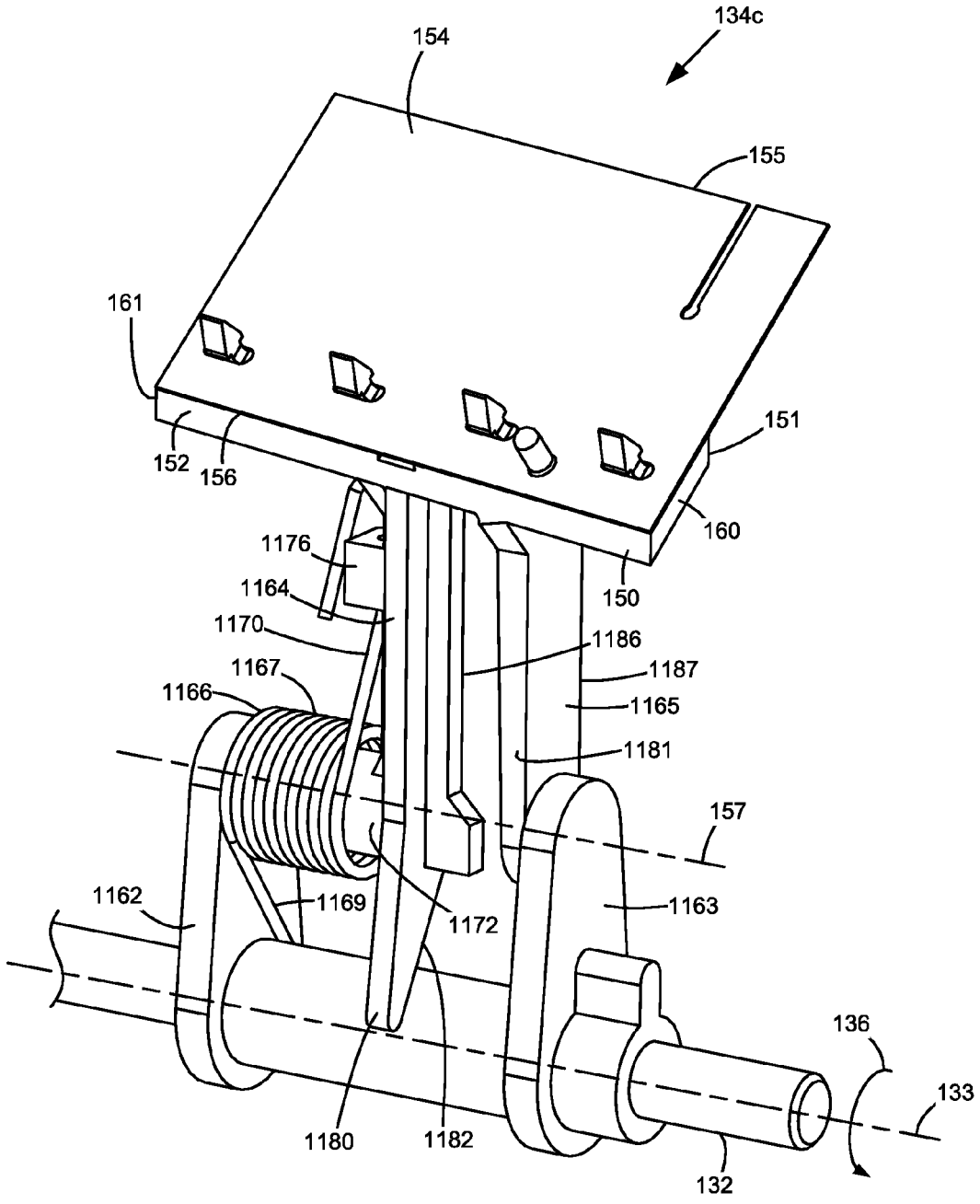
FIG. 10 is a perspective view of a second toner agitator in an extended position according to one example embodiment.
Figure 11:
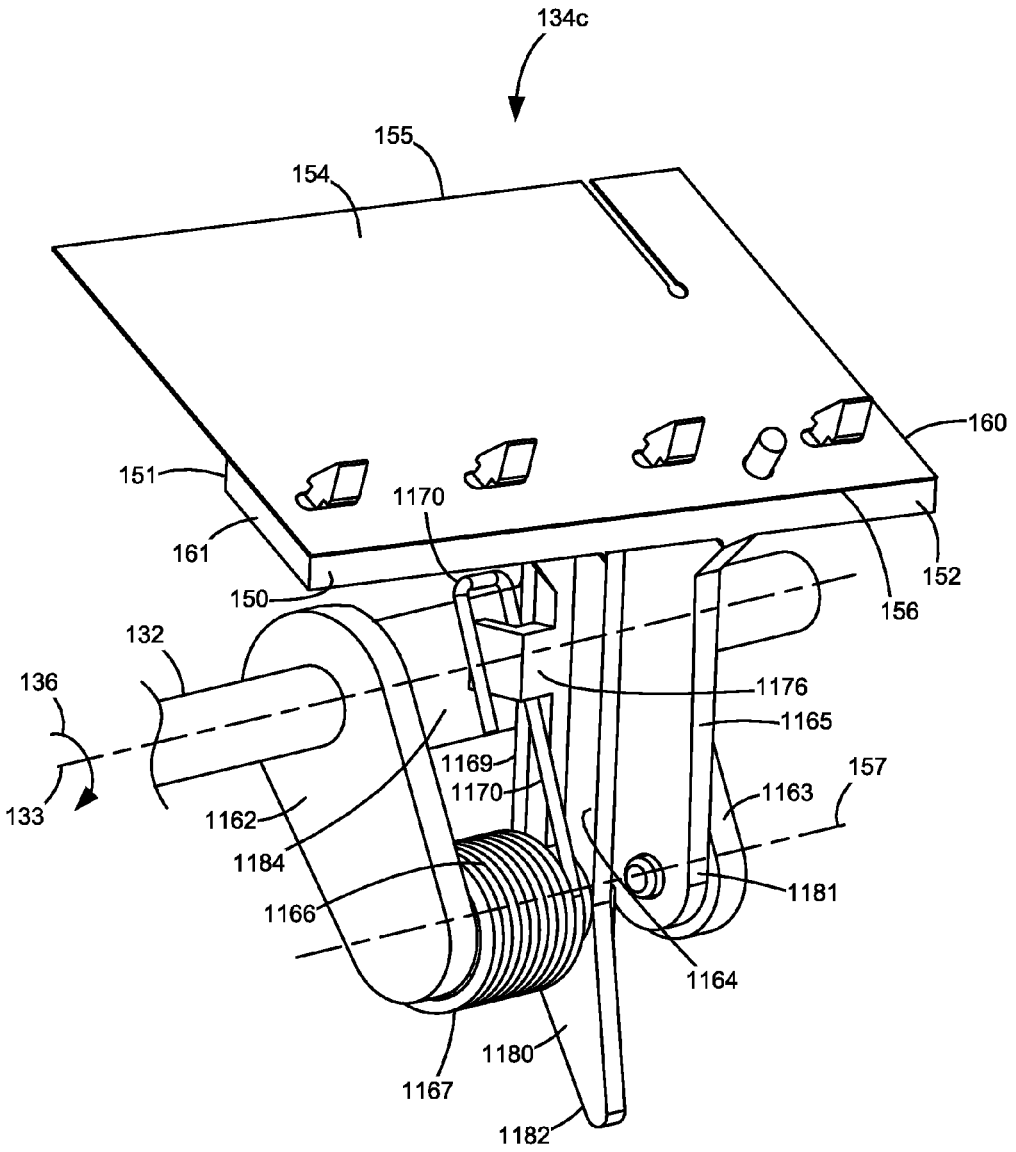
FIG. 11 is a perspective view of the second toner agitator in a retracted position according to one example embodiment.

FIGS. 10 and 11 show toner agitator 134*c* in greater detail according to one example embodiment. FIG. 10 shows toner agitator 134*c* in its extended position and FIG. 11 shows toner agitator 134*c* in its fully retracted position. Toner agitator 134*c* includes a pair of drive arms 1162, 1163 (similar to drive arms 162, 163 of toner agitator 134*a* discussed above) that are fixed to drive shaft 132 and axially spaced from each other relative to rotational axis 133 of drive shaft 132. Drive arms 1162, 1163 extend radially from drive shaft 132 and are fixed to rotate with drive shaft 132. In the example embodiment illustrated, paddle 150 and wiper 154 of toner agitator 134*c* are pivotally mounted to drive arms 1162, 1163 about pivot axis 157. Specifically, arms 1164, 1165 (similar to arms 164, 165 of toner agitator 134*a* discussed above), which are axially spaced from each other relative to rotational axis 133 of drive shaft 132, extend from paddle 150 of toner agitator 134*c* and are each pivotally mounted on a respective drive arm 1162, 1163. As discussed above, arms 1164, 1165 may be mounted to drive arms 1162, 1163 at pivot axis 157 of toner agitator 134*c* by corresponding mounting holes and posts, for example.

In the example embodiment illustrated, biasing member 158 includes a torsion spring 1166 having a spring coil 1167 and a pair of free arms 1169, 1170. Spring coil 1167 is wrapped around a corresponding spring post 1172 that extends axially inward from arm 1164. In the example embodiment illustrated, free arm 1169 is positioned against the base of drive arm 1162 and free arm 1170 is positioned against a rib 1176 formed on arm 1164 in order to bias toner agitator 134*c* in operative rotational direction 136. While the example embodiment illustrated includes a torsion spring 1166, as discussed above, any suitable biasing member 158 may be used as desired.

In one embodiment, arms 1164, 1165 can be separated from drive arms 1162, 1163 by manually squeezing arms 1164, 1165 toward each other (like arms 164, 165 of toner agitator 134*a* discussed above) providing relatively simple assembly and disassembly of paddle 150 of toner agitator 134*c* onto or off of drive arms 1162, 1163 and drive shaft 132.

Each arm 1164, 1165 of toner agitator 134*c* includes a proximal portion 1180, 1181 that is positioned proximate to drive shaft 132 when toner agitator 134*c* is in its extended position. In the example embodiment illustrated, proximal portion 1180 of arm 1164 includes a forward rotational stop 1182 (similar to forward rotational stops 182, 183 of toner agitator 134*a* discussed above) that limits the pivoting motion of toner agitator 134*c* about pivot axis 157 relative to drive arms 1162, 1163 and drive shaft 132 in the direction of bias on toner agitator 134*c* (i.e., in the operative rotational direction 136) and defines the extended position of toner agitator 134*c*. In the example embodiment illustrated, in the extended position of toner agitator 134*c*, forward rotational stop 1182 contacts a portion of the base of drive arms 1162, 1163 that is overmolded around drive shaft 132. In the example embodiment illustrated, arms 1164, 1165 extend in a substantially radial orientation relative to drive shaft 132 when toner agitator 134*c* is in its extended position.

In the example embodiment illustrated, the portion at the base of drive arms 1162, 1163 that is overmolded around drive shaft 132 forms a rearward rotational stop 1184. Rearward rotational stop 1184 limits how far toner agitator 134*c* is able to fold counter to operative rotational direction 136. In the embodiment illustrated, as toner agitator 134*c* folds counter to operative rotational direction 136, a trailing face 1186, 1187 of each arm 1164, 1165 (i.e., a face of each arm 1164, 1165 that trails as toner agitator 134*c* rotates in operative rotational direction 136) contacts rearward rotational stop 1184 when toner agitator 134*c* reaches the fully retracted position shown in FIG. 11.

Similar to toner agitator 134*a* discussed above, in the example embodiment illustrated, when toner agitator 134*c* is in a partially or fully retracted position, a proximal portion 1180, 1181 of arm 1164 and/or 1165 projects radially outward from pivot axis 157 ahead of paddle 150 and wiper 154 of toner agitator 134*c* in the operative rotational direction 136. The projection of proximal portion 1180, 1181 of arm 1164 and/or 1165 aids in cutting through and breaking up packed toner as discussed above.

Figure 12:
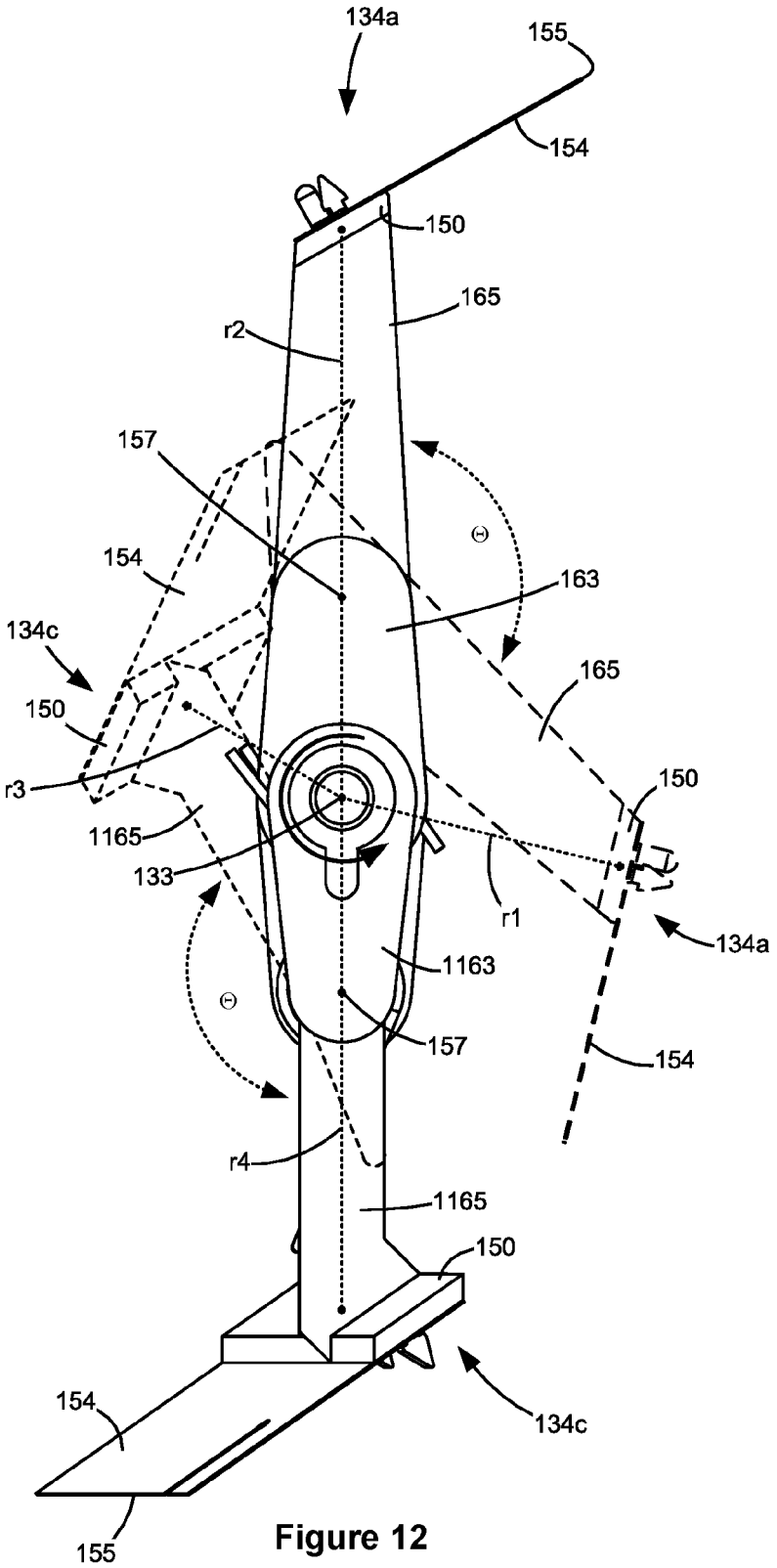
FIG. 12 is a side elevation view of the first and second toner agitators in extended and retracted positions according to one example embodiment.

FIG. 12 shows toner agitator 134*a* and 134*c* from one end of drive shaft 132. The extended positions of toner agitators 134*a* and 134*c* are shown in solid line in FIG. 12 and the fully retracted positions of toner agitators 134*a* and 134*c* are shown in dashed line in FIG. 12. FIG. 12 illustrates the reduction in radial length of toner agitators 134*a*, 134*c* when toner agitators 134*a*, 134*c* fold counter to operative rotational direction 136. As discussed above, the reduction in radial length of toner agitators 134*a*, 134*c* decreases the torque required to rotate toner agitators 134*a*, 134*c*. For example, as shown in FIG. 12, a radius r1 from rotational axis 133 of drive shaft 132 to a center of paddle 150 of toner agitator 134*a* when toner agitator 134*a* is in its fully retracted position is smaller than a radius r2 from rotational axis 133 of drive shaft 132 to the center of paddle 150 of toner agitator 134*a* when toner agitator 134*a* is in its extended position. Similarly, a radius r3 from rotational axis 133 of drive shaft 132 to a center of paddle 150 of toner agitator 134*c* when toner agitator 134*c* is in its fully retracted position is smaller than a radius r4 from rotational axis 133 of drive shaft 132 to the center of paddle 150 of toner agitator 134*c* when toner agitator 134*c* is in its extended position. In the example embodiment illustrated, in the fully retracted positions of toner agitators 134*a*, 134*c*, toner agitators 134*a*, 134*c* fold counter to operative rotational direction 136 by a maximum angle Θ of approximately 135 degrees. However, toner agitators 134 may fold to a greater or lesser degree in their fully retracted positions as desired.

As shown in FIG. 12, in the example embodiment illustrated, pivot axes 157 are positioned at approximately ⅓ the length of each toner agitator 134*a*, 134*c* (e.g., ⅓ the distance from rotational axis 133 of drive shaft 132 to the center of paddle 150 when toner agitator 134*a*, 134*c* is in its extended position). Positioning pivot axes 157 at approximately ⅓ the length of each toner agitator 134*a*, 134*c* allows roughly half of the portion of each toner agitator 134*a*, 134*c* that extends past pivot axis 157 in the extended position to be positioned on each side of drive shaft 132 when toner agitator 134*a*, 134*c* is fully retracted providing maximum reduction of the radial length of toner agitators 134*a*, 134*c*. That is, when toner agitator 134*a*, 134*c* is in the fully retracted position, roughly half of the portion of each toner agitator 134*a*, 134*c* that extends past pivot axis 157 in the extended position is positioned on one side of drive shaft 132 and the other half of the portion of each toner agitator 134*a*, 134*c* that extends past pivot axis 157 in the extended position is positioned on the other side of drive shaft 132.

While the example embodiments discussed above include toner agitators 134 having a paddle 150 having a substantially planar member and a wiper 154, it will be appreciated that the toner agitators may take many shapes, forms, sizes and orientations. For example, the toner agitator(s) may include any suitable combination of one or more rakes, combs, scoops, plows, spikes, arms, prongs, flaps, mixers, conveyors, etc. Further, while the example embodiments discussed above include a toner agitator assembly 130 in a toner reservoir 104 of toner cartridge 100, it will be appreciated that a toner agitator assembly that includes a toner agitator that folds counter to an operative rotational direction of the toner agitator may be used in any toner reservoir including, for example, the toner sump of developer unit 202, a reservoir that stores waste toner removed from the surface of photoconductive drum, etc.

Although the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202, and cleaner unit 204 are housed in one replaceable unit. In another embodiment, the main toner supply for image forming device 22 and developer unit 202 are provided in a first replaceable unit and cleaner unit 204 is provided in a second replaceable unit. Further, although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container for use in an electrophotographic image forming device, comprising:

a housing having a reservoir for storing toner;

a drive shaft positioned in the reservoir, the drive shaft is rotatable about a rotational axis in an operative rotational direction; and a rigid toner agitator that extends in a cantilevered manner from the drive shaft in the reservoir, the toner agitator is rotatable around the rotational axis of the drive shaft as the drive shaft rotates in the operative rotational direction, the toner agitator folds relative to the drive shaft counter to the operative rotational direction if resistance to rotation of the toner agitator provided by toner in the reservoir exceeds a threshold amount, the toner agitator is biased relative to the drive shaft in the operative rotational direction, wherein a radial length of the toner agitator from the rotational axis of the drive shaft to a free end of the toner agitator relative to the drive shaft decreases when the toner agitator folds relative to the drive shaft counter to the operative rotational direction.

2. The toner container of claim 1, wherein the toner agitator is pivotable relative to the drive shaft about a pivot axis that is offset from the rotational axis of the drive shaft and fixed relative to the rotational axis of the drive shaft.

3. The toner container of claim 2, wherein the pivot axis of the toner agitator is parallel to the rotational axis of the drive shaft.

4. The toner container of claim 1, wherein an exposed face of the toner agitator in the operative rotational direction decreases when the toner agitator folds relative to the drive shaft counter to the operative rotational direction.

5. The toner container of claim 1, wherein the toner agitator extends in a radial orientation relative to the drive shaft when the toner agitator is in a forwardmost position of the toner agitator relative to the drive shaft in the operative rotational direction.

6. The toner container of claim 1, wherein the toner agitator is pivotally mounted to a drive arm that extends radially from the drive shaft and that is fixed to rotate with the drive shaft.

7. The toner container of claim 6, wherein the drive arm includes a first drive arm and a second drive arm that are axially spaced from each other relative to the rotational axis of the drive shaft, each of the first drive arm and the second drive arm extends radially from the drive shaft and is fixed to rotate with the drive shaft, the toner agitator is pivotally mounted to the first and the second drive arms.

8. The toner container of claim 6, wherein the toner agitator includes an arm that is pivotally mounted to the drive arm, a proximal end of the arm is positioned proximate to the drive shaft when the toner agitator is in a forwardmost position of the toner agitator relative to the drive shaft in the operative rotational direction and the proximal end of the arm projects forward in the operative rotational direction ahead of the drive arm when the toner agitator folds relative to the drive shaft counter to the operative rotational direction.

9. The toner container of claim 1, wherein a proximal end of the toner agitator opposite the free end of the toner agitator projects forward in the operative rotational direction when the toner agitator folds relative to the drive shaft counter to the operative rotational direction.

10. The toner container of claim 1, wherein the toner agitator is biased in the operative rotational direction by a double torsion spring, the double torsion spring includes a pair of spring coils and a connecting arm that connects the pair of spring coils to each other and that contacts a trailing portion of the toner agitator relative to the operative rotational direction biasing the toner agitator relative to the drive shaft in the operative rotational direction.

11. A toner container for use in an electrophotographic image forming device, comprising:

a housing having a reservoir for storing toner;

a drive shaft positioned in the reservoir, the drive shaft is rotatable about a rotational axis in an operative rotational direction; and a toner agitator that extends outward from the drive shaft in the reservoir, the toner agitator is rotatable around the rotational axis of the drive shaft as the drive shaft rotates in the operative rotational direction, the toner agitator is pivotable relative to the drive shaft about a pivot axis that is offset from the rotational axis of the drive shaft, the pivot axis of the toner agitator is fixed relative to the rotational axis of the drive shaft, the toner agitator is biased relative to the drive shaft in the operative rotational direction toward an extended position of the toner agitator, the toner agitator moves from the extended position to a retracted position of the toner agitator when the toner agitator pivots about the pivot axis from the extended position counter to the operative rotational direction, a distal end of the toner agitator is positioned farthest from the rotational axis of the drive shaft when the toner agitator is in the extended position, wherein a radial length of the toner agitator from the rotational axis of the drive shaft to the distal end of the toner agitator is greater when the toner agitator is in the extended position than when the toner agitator is in the retracted position.

12. The toner container of claim 11, wherein the pivot axis of the toner agitator is parallel to the rotational axis of the drive shaft.

13. The toner container of claim 11, wherein an exposed face of the toner agitator in the operative rotational direction decreases when the toner agitator moves from the extended position to the retracted position.

14. The toner container of claim 11, wherein the toner agitator extends in a radial orientation relative to the drive shaft when the toner agitator is in the extended position.

15. The toner container of claim 14, wherein the pivot axis of the toner agitator is positioned at ⅓ the radial length of the toner agitator when the toner agitator is in the extended position.

16. The toner container of claim 11, wherein the toner agitator is pivotally mounted about the pivot axis to a drive arm that extends radially from the drive shaft and that is fixed to rotate with the drive shaft.

17. The toner container of claim 16, wherein the drive arm includes a first drive arm and a second drive arm that are axially spaced from each other relative to the rotational axis of the drive shaft, each of the first drive arm and the second drive arm extends radially from the drive shaft and is fixed to rotate with the drive shaft, the toner agitator is pivotally mounted about the pivot axis to the first and the second drive arms.

18. The toner container of claim 16, wherein the toner agitator includes an arm that is pivotally mounted to the drive arm at the pivot axis of the toner agitator, a proximal end of the arm is positioned proximate to the drive shaft when the toner agitator is in the extended position and the proximal end of the arm projects forward in the operative rotational direction ahead of the drive arm when the toner agitator is in the retracted position.

19. The toner container of claim 11, wherein a proximal end of the toner agitator opposite the distal end of the toner agitator relative to the pivot axis of the toner agitator projects forward in the operative rotational direction when the toner agitator is in the retracted position.

20. The toner container of claim 11, wherein the toner agitator is biased toward the extended position of the toner agitator by a double torsion spring, the double torsion spring includes a pair of spring coils and a connecting arm that connects the pair of spring coils to each other and that contacts a trailing portion of the toner agitator relative to the operative rotational direction biasing the toner agitator relative to the drive shaft in the operative rotational direction.

* * * * *